US006214137B1

(12) United States Patent
Lee et al.

(10) Patent No.: US 6,214,137 B1
(45) Date of Patent: Apr. 10, 2001

(54) HIGH PERFORMANCE EXPLOSIVE CONTAINING CL-20

(75) Inventors: Kenneth E. Lee, No. Ogden; Robert L. Hatch, Wellsville, both of UT (US); Mark Mezger, Mount Bethel, PA (US); Steve Nicolich, Wyckoff, NJ (US)

(73) Assignee: Cordant Technologies Inc.

( * ) Notice: Subject to any disclaimer, the term of this patent is extended or adjusted under 35 U.S.C. 154(b) by 0 days.

(21) Appl. No.: 09/166,842

(22) Filed: Oct. 6, 1998

Related U.S. Application Data

(60) Provisional application No. 60/061,245, filed on Oct. 7, 1997.

(51) Int. Cl.[7] ..... C06B 45/10
(52) U.S. Cl. ..... 149/19.7; 149/92
(58) Field of Search ..... 149/19.7, 92

(56) References Cited

U.S. PATENT DOCUMENTS

| | | | | |
|---|---|---|---|---|
| 3,138,501 | | 6/1964 | Wright | 149/92 |
| 3,173,817 | | 3/1965 | Wright | 149/2 |
| 3,296,041 | | 1/1967 | Wright | 149/2 |
| 3,544,360 | | 12/1970 | Gardner | 117/100 |
| 4,357,185 | | 11/1982 | Ringbloom | 149/6 |
| 4,361,450 | | 11/1982 | Munson | 149/38 |
| 4,842,659 | | 6/1989 | Mezger et al. | 149/19.2 |
| 5,468,313 | * | 11/1995 | Wallace et al. | 149/53 |
| 5,472,531 | | 12/1995 | Turci et al. | 149/92 |
| 5,487,851 | * | 1/1996 | Dillehay et al. | 264/3.3 |
| 5,500,060 | | 3/1996 | Holt et al. | 149/19.1 |
| 5,529,649 | | 6/1996 | Lund et al. | 149/19.3 |
| 5,565,651 | | 10/1996 | Kim et al. | 149/19.92 |
| 5,587,553 | | 12/1996 | Braithwaite et al. | 149/19.6 |
| 5,623,116 | | 4/1997 | Hamilton et al. | 102/289 |
| 5,690,868 | * | 11/1997 | Strauss et al. | 149/19.9 |
| 5,712,511 | | 1/1998 | Chan et al. | 264/3.4 |
| 5,716,557 | * | 2/1998 | Strauss et al. | 149/19.6 |
| 5,750,920 | | 5/1998 | Redecker et al. | 149/11 |
| 5,798,481 | * | 8/1998 | Manning et al. | 149/19.8 |

FOREIGN PATENT DOCUMENTS

WO 94/18144 8/1994 (WO) .

OTHER PUBLICATIONS

Wardle et al., "Synthesis of the caged nitramine HNIW (CL–20)", p. 301, XP 000664704 Chemical Abstracts, vol. 125, No. 14, Sep. 30, 1996.

* cited by examiner

*Primary Examiner*—Edward A. Miller

(57) ABSTRACT

High performance explosive compositions and ordnances using the explosive compositions as an explosive ingredient for high performance, low sensitivity explosive applications are disclosed. The explosive formulation includes CL-20 as an explosive ingredient, and a binder system including cellulose acetate butyrate as a non-energetic binder and bis-dinitropropyl acetal and bis-dinitropropyl formal as an energetic plasticizer. The CL-20 may be present in the explosive formulation in a concentration of from about 85 wt % to about 96 wt %. The formulation is preferably sufficiently pressable and/or extrudable to permit it to be formed into grains suitable for ordnance and similar applications, including use as grenades, land mines, missile warheads, and demolition explosives.

12 Claims, 2 Drawing Sheets

HIGH PERFORMANCE EXPLOSIVE CONTAINING CL-20

This application claims the benefit of U.S. Provisional Application No. 60/061,245, filed Oct. 7. 1997. +gi

ORIGINATION OF INVENTION

Certain specific formulations described herein were made by, or under a contract with, U.S. Army Tank Automotive and Armaments Command (TACOM)—Armament Research Development and Engineering Center (ARDEC) under Government Contract DAAA21-94-D-0003.

BACKGROUND OF THE INVENTION

1. Field of the Invention

This invention relates to high performance explosive compositions that are pressable or extrudable, and to devices and apparatuses using the explosive compositions as an explosive ingredient for high performance, low sensitivity explosive applications. More specifically, this invention relates to high performance explosive compositions comprising CL-20, energetic plasticizers, and high molecular weight non-energetic polymeric binders.

2. Description of the Related Art

Among the litany of high performance explosives that have been used in ordnance and other high impact applications, a relatively new explosive known as CL-20 has been recognized for its superior energy levels that far surpass those of most conventional explosives. CL-20, is referred to commonly as (2,4,6,8,10,12-hexanitro-2,4,6,8,10,12-hexaazatetracyclo[$5.5.0.0^{5,9}.0^{3,11}$]-dodecane and 2,4,6,8,10,12-hexanitrohexaazaisowurtzitane.

Examples of explosive formulations containing CL-20 as the primary explosive component are disclosed in both U.S. Pat. No. 5,587,553 to Braithwaite et al. and U.S. Pat. No. 5,712,511 to Chan et al. As touched upon in the Chan et al. '511 patent, which relates to explosive compositions for deformable-type warheads and directional ordnances, CL-20 is extremely sensitive to physical impact. Indeed, CL-20 has been associated with high electrical and thermal sensitivities as well. The highly sensitive nature of CL-20 may lead to premature detonation in ordnance applications. The Chan et al. patent apparently compensates for the high sensitivity of CL-20 by incorporating it into high energy shock-insensitive explosive compositions comprised of a relatively low concentration of CL-20, e.g., from about 35 wt % to about 45 wt %.

In contrast, the Braithwaite et al. patent seeks to improve the high performance of the CL-20 explosive by using it in high concentrations and in combination with high molecular weight liquid energetic polymers, especially chain-extended polyglycidyl nitrate (PGN). It has also been known to use CL-20 in combination with other polymers. One such combination commonly known as LX-19 combines CL-20 with ESTANE ($C_{5.14}H_{7.5}N_{0.187}O_{1.76}$). The performance characteristics, e.g., energy levels, exhibited by LX-19 are generally considered to be excellent. However, the impact, electrical, and thermal sensitivities associated with LX-19 and other formulations using CL-20 in combination with energetic binders are considered to be too high for some applications.

It would, therefore, be a significant advancement in the art to provide a plastic bonded explosive formulation that contains a sufficient amount of CL-20 to exhibit equal or better high energy performance than LX-19, yet which has sufficiently low impact, electrical, and thermal sensitivities to permit the formulation to be used for a variety of applications without an unacceptable risk of unintentional or premature detonation.

SUMMARY OF THE INVENTION

It is, therefore, an object of this invention to provide a pressable or extrudable high performance explosive formulation that addresses the aforementioned problems associated with the related art and realizes the advancement expressed above.

In accordance with the principles of this invention, these and other objects are attained by providing an explosive formulation prepared from high molecular weight polymers precipitated onto high performance explosives comprising CL-20. Generally, this formulation includes about 85 wt % to about 95 wt % CL-20, and about 5 wt % to about 15 wt % of a binder system. The binder system comprises at least one non-energetic polymeric binder, preferably cellulose acetate butyrate (CAB), and at least one energetic plasticizer, preferably bis-dinitropropyl acetal/bis-dinitropropyl formal (BDNPA/F). The weight ratio of bis-dinitropropyl acetal to bis-dinitropropyl formal in the BDNPA/F should be selected to provide the plasticizer in a substantially liquid and free flowing state. Preferably, this weight ratio is between about 45:55 and about 55:45, and more preferably about 50:50.

According to a preferred embodiment of the invention, the formulation includes about 94 wt % CL-20, about 2 wt % to about 2.8 wt % non-energetic binder, and about 3.2 wt % to about 4 wt % energetic plasticizer. More preferably, the formulation includes about 94 wt % CL-20, about 2.4 wt % non-energetic binder, and about 3.6 wt % energetic plasticizer.

This invention also relates to articles comprising the above-discussed formulations. The formulation is preferably sufficiently pressable or extrudable to permit it to be formed into grains or billets, for example, suitable for ordnance and similar applications. The principles of the present invention outlined above are applicable to a variety of explosive articles, but have particular applicability to pressed or injection loaded ordnances such as grenades, land mines, missile warheads, and demolition explosives.

These and other objects, features, and advantages of the present invention will become apparent from the accompanying drawing and following detailed description which illustrate and explain, by way of example, the principles of the present invention.

DETAILED DESCRIPTION OF THE INVENTION

The present invention is directed to high solids pressable or extrudable explosive compositions including CL-20 as a high performance explosive and a binder system. The high performance explosive CL-20 preferably is present in the formulation in a concentration sufficiently high to meet the calculated performance parameters of the current standard, LX-19. The formulation of this invention may include about 85 wt % to about 96 wt % CL-20, more preferably about 94 wt % to about 95 wt % CL-20, and still more preferably about 94 wt % CL-20.

The inventive formulation further includes a binder system that makes the formulation, and in particular the CL-20, less vulnerable to external stimuli. The binder system is selected and present in such concentrations as to convey to the inventive formulation a high bulk density, which aids in achieving high pressed densities. Generally, the bulk density (unpressed) of the granules should at least 0.85 grams/cc, and preferably should be at least 1.0 grams/cc. The binder system includes at least cellulose acetate butyrate (CAB) as a non-energetic binder and bis-dinitropropyl acetal and bis-dinitropropyl formal (BDNPA/F) as an energetic plasticizer. The ratio of bis-dinitropropyl acetal to bis-dinitropropyl formal in the BDNPA/F should be selected to provide the mixture in a liquid and substantially free flowing state. Preferably, the ratio by weight is between about 45:55 and about 55:45, and more preferably about 50:50. In accordance with one preferred embodiment, the formulation contains the CAB binder in a concentration of from about 2 wt % to about 2.8 wt % CAB and the BDNPA/F plasticizer in a concentration of from about 3.2 wt % to about 4 wt %. More preferably, the formulation includes about 2.4 wt % CAB and about 3.6 wt % BDNPA/F.

Among the additional additives which may be included in formulation are metals such as boron, magnesium, and aluminum and conductive carbon fibers.

Figure 1:
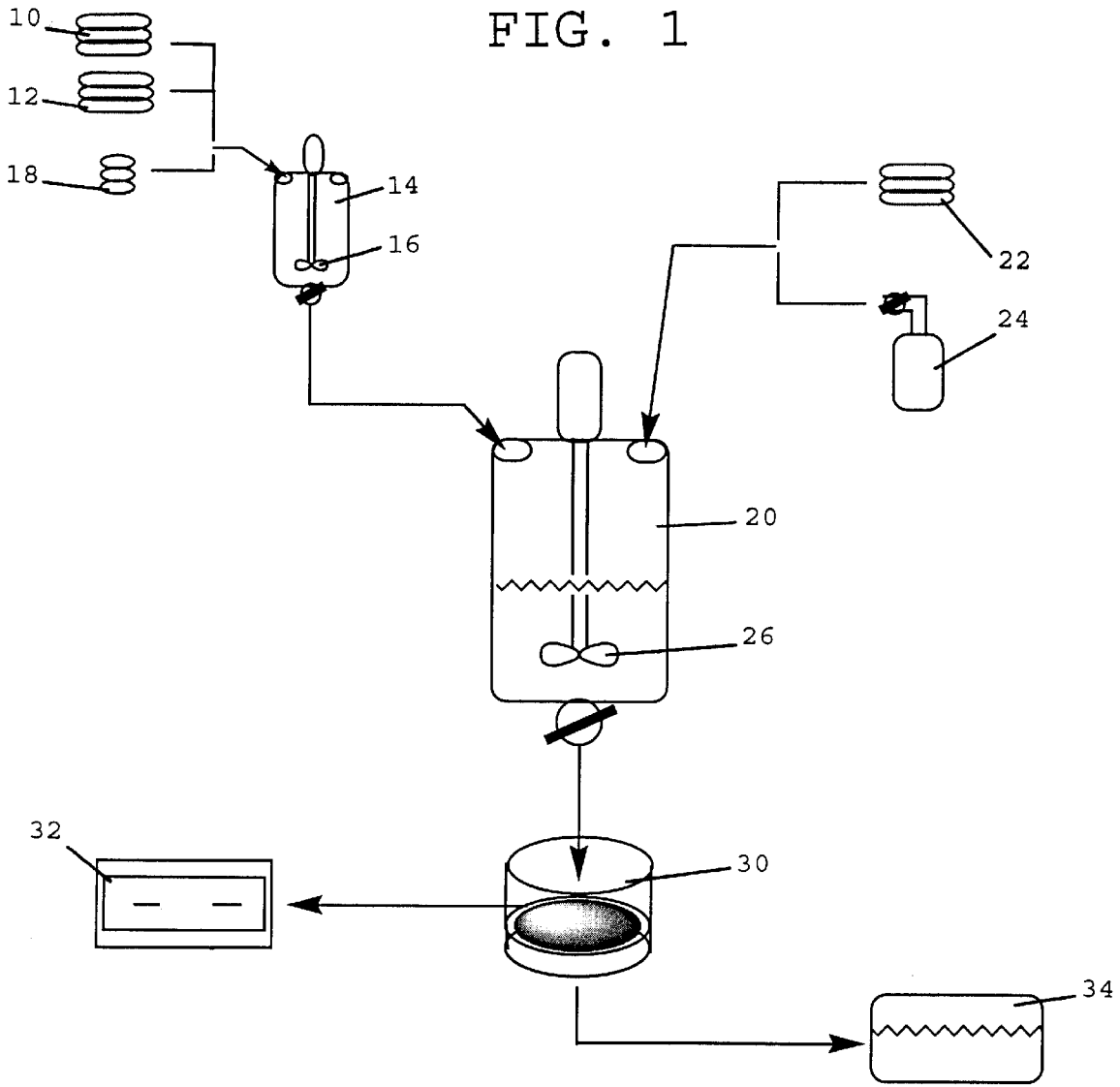
FIG. 1 is a schematic of an example of a slurry emulsion process suitable for preparing exemplary formulations according to the present invention.

The formulations of this invention can be prepared, for example, in a water slurry process conducted at or near ambient temperature. Referring to FIG. 1, the preparatory process in accordance with one embodiment is conducted via a batchwise technique by charging CAB and BDNPA/F from respective storage tanks 10 and 12 into a lacquer mixing vessel 14 equipped with stirrer 16. Solvent is provided from storage tank 18 to the lacquer mixing vessel 14. Although not shown, an antioxidant may also be added via another storage tank to the lacquer mixing vessel 14. Suitable solvents include, by way of example, the following: straight chain and cyclic low molecular weight hydrocarbons, such as hexane, heptane, cyclohexane, and cycloheptane; low molecular weight alcohols, such as methanol, ethanol, propanol, isopropanol, and butanol; and esters such as ethyl acetate. Suitable antioxidants include diphenylamine and n-alkyl nitroanilines, in which the n-alkyl group may be, for example, methyl, ethyl, and other low molecular weight alkyl groups such as isopropyl.

An aqueous dispersion was made by charging CL-20 from storage tank 22 and water from storage tank 24 into a jacketed mixer 20 equipped with stirrer 26. In terms of the concentration of water, if an insufficient amount of water is provided, the lacquer will not be sufficiently diluted, so that the granules grow too quickly and may agglomerate and stick to the bottom and sides of the jacketed mixer 20. On the other hand, if too much water is added, the growth rate of the granules will be impeded, resulting in small and highly sensitive granules. Generally, the weight ratio of CL-20 to water may be about 3.0:1 to about 5.0:1, preferably from about 3.5:1 to about 4.5:1, and more preferably about 4:1.

After the aqueous CL-20 dispersion is formed and agitated, the lacquer from tank 14 is introduced into the jacketed tank 20 in such a manner that the non-energetic polymeric binder CAB and energetic plasticizer precipitate as a powder onto the CL-20. The ratio of solvent to water should be selected so as to be sufficiently high that the lacquer has low viscosity and high flowability to permit it to disperse in the slurry, yet should not be so high as to cause a significant amount of dissolution of the CL-20 in the water suspension. Generally, the concentration of solvents in the process, which should be minimized to reduce the waste stream for environmental concerns, is affected by several variables, including the solvent selected and the concentration of CL-20. When viewed in reference to this disclosure, ascertaining suitable solvent concentrations would be within the purview of the skilled artisan without undue experimentation. By way of example, the weight ratio of water to ethyl acetate may be about 6.3:1 for a CL-20 concentration of 90 wt %, and 9.6:1 for 94 wt % CL-20.

The addition rate of the lacquer to the CL-20 aqueous dispersion may be selected so that rounded and hard granular agglomerates are formed. If the lacquer is added too quickly, the agglomerations of particles may become too large for practical applications; conversely, if the lacquer is added too slowly, the resulting granules may be characterized by small irregular shapes and high sensitivities. Preferably, the granular agglomerates are from about 0.85 mm to about 4 mm. The temperature at which the process is conducted is dependent upon the solvent, and in particular should not be higher than the boiling point of the solvent. Also, the temperature of the process should not be so high as to cause polymorph conversion of the CL-20. Generally, the temperature can be within a range of from about 30° C. to about 50° C.

Surfactants may also be added into the jacketed mixer 20. Suitable surfactants include, by way of example, low molecular weight alcohols, such as 1-butanol and isopropyl alcohol. It is has been found that 1-butanol has synergistic effects with CL-20 in regard to its defoaming capabilities. The concentration of surfactant introduced into the process should be sufficiently high to reduce foaming so that a yield of at least 99% by weight, preferably 100% by weight, is achieved.

Figure 2:
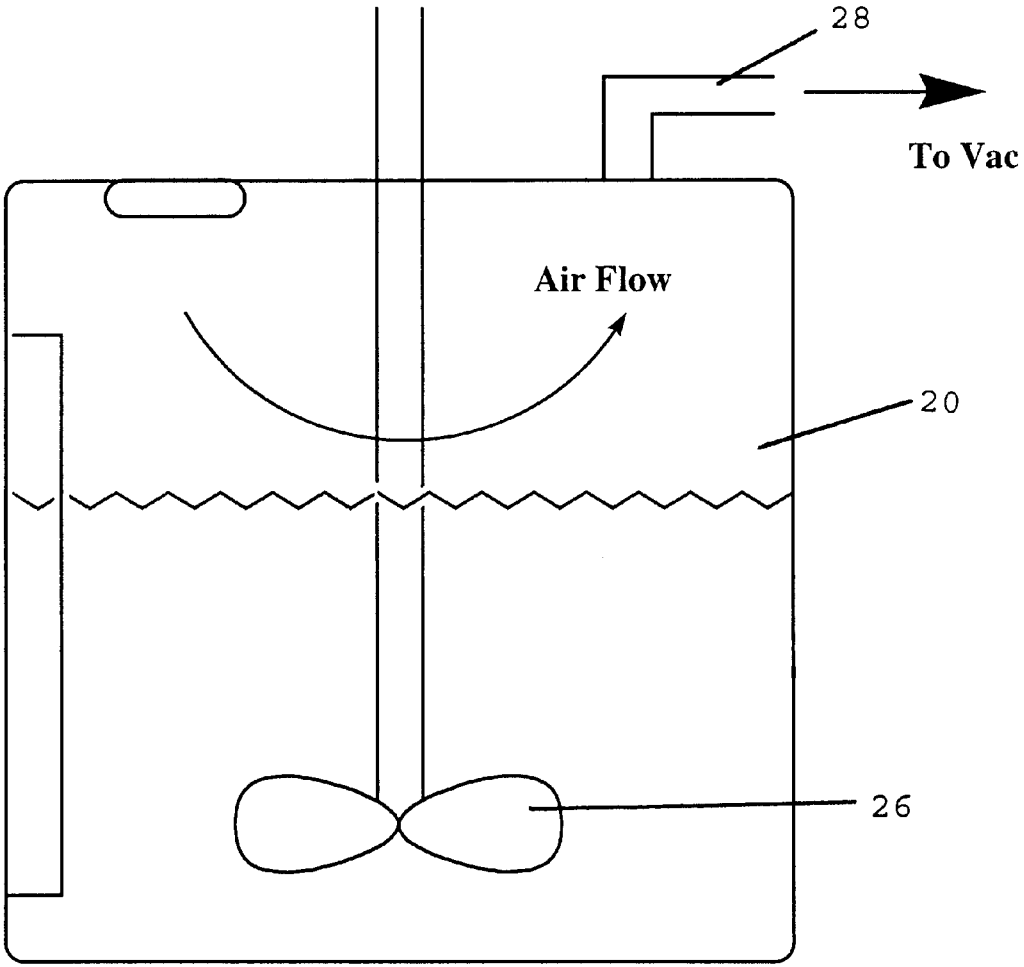
FIG. 2 is a schematic of a jacketed mixer suitable for use in the process illustrated in FIG. 1.

The granules begin to take shape as the lacquer is added into the jacketed mixer 20, and have for the most part taken their final form by the time the addition of lacquer is completed. Referring to FIG. 2, during stirring of the granules an air sweep may be passed through the jacketed mixer 20 to create a partial vacuum. The air sweep tends to remove solvent, surfactant, and water from the jacketed mixer 20 through vent 28. The granules may then be further rinsed with water while continuing stirring to prevent unacceptable amounts of agglomeration.

The granules and water are then poured onto a primary filter 30 for drying. The granules are then passed to an oven or dryer 32 and spread out and subjected to a vacuum for at least about 24 hours at about 49–54° C. Excess solvent is passed to waste tank 34 for eventual recovery or disposal. Although not shown in FIGS. 1 and 2, for larger scale processes a secondary recovery system comprising a secondary filter, vacuum collection tanks, and heat exchanger may be employed.

Priority is hereby claimed on provisional application 60/061,245 filed in the U.S. Patent & Trademark Office on Oct. 7, 1997, and the complete disclosure of that provisional application is incorporated herein by reference.

The following examples have been selected and are being presented to further describe the principles of this invention. These examples are given by way of example, and are not intended and should be interpreted as exhaustive of or as a restriction on the overall scope of this invention.

EXAMPLES

The CL-20 used in the examples and comparative examples was of the $\epsilon$ polymorph, i.e., high density form. The CL-20 (supplied by Thiokol Corporation, now Cordant Technologies, Inc.) was crystallized using a non-chlorinated solvent process which dramatically improved the particle shape from sharp to rounded edges. Such a process is described in U.S. Ser. No. 08/991,432 (allowed on Aug. 14, 1998), the complete disclosure of which is incorporated herein by reference. The particles generally had an average size of 150 microns. The water-wet CL-20 was then used as a feed stock for grinding and sieving to obtain a wide variety of particle size distributions. The CL-20 particle sizes used in the examples and comparative examples were 150 microns for the unground particles, and 6 microns for the ground particles.

Example 1

A 950 gram sample of the inventive formulation was prepared in a 10 liter slurry mixer containing baffles and an air driven agitator as follows. The mixer was charged with 2700 grams of water and agitated at 300 rpm. To the water was added 651.9 grams unground and 241.1 grams ground CL-20 to form a slurry, which was agitated until the temperature stabilized at 30° C. Next, 34.2 grams of BDNPA/F (50/50%) supplied by Thiokol Corporation, now Cordant Technologies, Inc. (71 wt % dispersion in n-butanol) was then added to the slurry, and the container from which the BDNPA/F was added was rinsed with 14 grams of n-butanol, which was added to the slurry. Then, 22.8 grams of CAB supplied by Eastman Chemical (7.7 wt % dissolved in hot ethyl acetate supplied by Fisher) was added slowly over a 10 minute period, and the container from which the CAB was added was rinsed with 50 grams of ethyl acetate, which was added to the slurry. The mixer was evacuated, and the solution maintained at a temperature of 30° C. while the agitation rate was increased to 375 rpm. After mixing for five minutes, 500 grams of water was added. The slurry was again mixed for 5 minutes, an additional 500 grams of water was added, and the agitation rate was increased to 450 rpm for five minutes. The heat source was then removed, and 1000 grams of water was added, followed by mixing for 5 minutes. Agitation was then ceased, and granules were obtained from the mixer, rinsed, then dried on a screen at 57° C. for 16–24 hours.

Example 2

A 900 gram formulation was prepared as follows. CAB was dissolved in ethyl acetate at 65° C. in a weight ratio of ethyl acetate to CAB of 13:1 while agitating, i.e., stirring, the ethyl acetate. Next, BDNPA/F (50/50 wt %) in a weight ratio to CAB of 3:2 was also dissolved in ethyl acetate at 65° C. which continuing stirring. An antioxidant, diphenylamine, was added to the lacquer at the same time as the BDNPA/F. The amount of antioxidant added should be calculated to constitute 0.2 wt % of the finished formulation. The lacquer was then set to 60° C. while continuing stirring.

CL-20 (weight ratio of unground to ground of 73:27) was separately combined with water at 30° C. in a weight ratio of 1:4 while stirring at 400–500rpm to form an aqueous dispersion at 30° C. N-butanol as a surfactant was added to the aqueous dispersion at a weight ratio of CL-20 to n-butanol of 8.8:1 Mixing was continued until the foam at the top of the aqueous dispersion subsided.

The lacquer was then added to the CL-20 aqueous dispersion at a rate of 9.5 grams per minute while stirring at 400–500 rpm until a formulation having a ratio of CL-20 to CAB/BDNPA/F of 9:1 was provided. During the addition, an air sweep created by a vacuum pump was present over the formulation. After the addition was completed, the stirring rate of 400–500 rpm, the temperature of 30° C., and the air sweep were maintained for 10 minutes. Then, quenching was performed by adding water in an amount of 1.1 grams of water per gram of formulation. The water was then filtered from the resulting granules on a metal screen at ambient conditions, after which the granules were dried at about 49–54° C. in a vacuum oven for 24 hours.

Example 3

The same procedures discussed above in Example 2 were followed, with the following exceptions. The ratio of CL-20 to CAB/BDNPA/F was changed to 94:6. Also, the weight ratio of water to CL-20 was 3.3:1 during formation of the aqueous dispersion and the weight ratio of CL-20 to surfactant was 8.5:1. The addition rate of the lacquer to the CL-20 dispersion was 21 grams/minute. In the quenching stage, 2.1 grams of water per gram of formulation was added.

Comparative Example A (LX-19)

A 1000 gram sample was prepared in a 10 liter slurry mixer containing baffles and an air driven agitator as follows. The mixer was charged with 3500 grams of water and agitated. To the water was added 718.5 grams unground and 239.5 grams ground CL-20 to form a slurry, which was agitated until the temperature stabilized at 42.5° C. Next, 42.2 grams of ESTANE (from B.F. Goodrich) in 300 grams of ethyl acetate was added to the slurry, and the container from which the ESTANE was added was rinsed three times with 10 grams (30 grams total) of ethyl acetate, which was added to the slurry. The mixer was evacuated, and the solution maintained at a temperature of 42.5° C. with agitation. After mixing for about 60 minutes, 2000 grams of water was added. The slurry was again mixed for 10 minutes. Agitation was then ceased, and granules were obtained from the mixer, rinsed, then dried on a screen at about 49° C. to 54° C. for 48 hours.

Comparative Example B

A 100 gram sample was prepared in a 1 liter slurry mixer containing baffles and an air driven agitator as follows. The mixer was charged with 200 ml grams of water and agitated. To the water was added 63.7 grams unground and 27.3 grams ground CL-20 to form a slurry, which was agitated until the temperature stabilized at room temperature. Next, 9 grams of chain-extended PGN (average molecular weight 119.756) in 13.5 grams of methylene chloride was added to the slurry, and the container from which the PGN was added was rinsed once methylene chloride, which was added to the slurry. The mixer was evacuated, and the solution maintained at an ambient temperature with agitation at 800 rpm. After mixing for about 10 minutes, 200 ml of water was added. The slurry was again mixed for 5 minutes at 800 rpm. Agitation was then ceased, and granules were obtained from the mixer, rinsed, then dried on a screen at about 50° C.

Comparative Example C

The same procedures set forth above in Comparative Example C were followed, except that 66.5 grams unground and 28.5 grams ground CL-20 and 5 grams of PGN were added to form the slurry.

Set forth below in the TABLE are the formulations and performance properties evaluated for Examples 1–3 and Comparative Examples A–C.

TABLE

| | EXAMPLE | | | COMPARATIVE EXAMPLE | | |
|---|---|---|---|---|---|---|
| | 1 | 2 | 3 | A | B | C |
| CL-20[1] | 94 | 90 | 94 | 95.8 | 91 | 95 |
| CAB & BDNPA/F | 6 | 10 | 6 | — | — | — |
| ESTANE | — | — | — | 4.2 | — | — |
| PGN | — | — | — | — | 9 | 5 |
| ABL Impact (cm)[2] | 26 | 21 | 17 | 3.5 | 6.9 | 3.5 |

TABLE-continued

| | EXAMPLE | | | COMPARATIVE EXAMPLE | | |
|---|---|---|---|---|---|---|
| | 1 | 2 | 3 | A | B | C |
| ABL Frict. (psi @ 8 ft/s)[3] | 240 | 130 | 320 | 370 | 100 | 100 @ 4 ft /sec |
| IHE- mini card gap (#, 0.01")[4] | — | 177 | 190 | 260 | 231 | 231 |
| TMD (99% g/cc)[5] | 1.98 | 1.92 | 1.96 | 1.96 | 1.95 | 1.98 |
| $P_{cj}$ (kbar)[6] | 421 | 393 | 421 | 418 | 417 | 438 |
| Det. Vel. (km/s)[7] | 9.23 | 9.23 | 9.50 | 9.44 | 9.48 | 9.73 |
| Cylind. Expans. Energy. @ $V/V_o$= 6.5 (kJ/cc)[8] | 10.1 | 9.54 | 10.1 | 9.98 | 10.1 | 10.5 |
| Conf.[9] 0.00" | — | — | — | Burn | — | — |
| Conf. 0.015" | — | — | — | Expl | Det | Det |
| Conf. 0.030" | — | Pre Rup | Expl | Par Det | Det | Det |
| Conf. 0.045" | — | Pre Rup | Expl | — | — | — |
| Conf. 0.060" | — | Pre Rup | Expl | — | — | — |

[1]The chemical analysis of the explosive compositions included High Performance Liquid Chromatography (HPLC), Gel Permeation Chromatography (GPC), and gravimetric methods for the determination of the granule chemical composition.

[2]ABL Impact tests use a two-kilogram drop weight held and released by an electromagnet to impact a hardened steel striker resting on the sample. The sample interface of the striker is flat and 0.5 inch in diameter. The sample rests on a 1-inch diameter hardened steel anvil. The level at which 10 no-fires, i.e., smoke, sparks, or ignition, is reported as the ABL impact level.

[3]ABL Friction tests are conducted by providing a sample on a steel plate so that the sample is positioned between the steel plate and a fixed steel wheel, and sliding the plate over a 1 inch distance at 3–8 feet/second. The wheel is nominally 2.0 inches in diameter and 0.125 inches thick with a Rockwell hardness of 40–50. The plate is 2.25 inches wide by 6.5 inches long and hardened to a Rockwell hardness of 58–62. The level at which 20 no-fires are obtained is reported as the ABL Friction level.

[4]In the standard "card gap" test, an explosive primer is detonated a set distance from the subject explosive. The space between the primer and the explosive is filled with an inert material such as PMMA (polymethylmethacrylate). The distance is expressed in cards, where 1 card is equal to 0.01 inch. The NOL Card Pipe Test is more fully described in Joint Technical Bulletin NAVSEA INST 80208B TO 11A-1-47 DLAR 8220.1.

The theoretical maximum density (TMD) was calculated based on the density of the CL-20 and the densities of the binder and plasticizer by the software CHEETAH available through Lawrence Livermore National Laboratory of Livermore, Ca.

[6]Detonation Pressure (Champman-Jouguet)

[7]Procedures for measuring detonation velocity, which is the velocity with which a steady detonation travels through an explosive, are described at pages 234–35 of Las Alamos National Scientific Laboratory (LASL) Explosive Property Data (P.R. Gibbs & Popolato 1980).

[8]Procedures for measuring cylinder expansion volume, developed at the Lawrence Livermore Laboratory, are described at page 249 of LASL Explosive Property Data.

[9]Measured by the Variable Confined Cook-Off Test (VCCT) developed by the Navy. Zero confinement represents where no steel sleeve surrounds an aluminum sleeve that encases the sample. The remaining confinement numbers represent the thickness in inches of the steel sleeve. Burn, pressure rupture, deflagration, and explosion responses are considered passing, whereas more violent reactions, i.e., partial and total detonation, are considered failing. Reaction levels in order from least active to most active are as follows:

BRN = BURN
PRE RUP = PRESSURE RUPTURE
DEFLA = DEFLAGRATION
EXPL = EXPLOSION
PAR DET = PARTIAL DETONATION
DET = DETONATION

As evident from the results tabulated in the TABLE, Examples 1 and 3 and Comparative Examples A and C all exhibited substantially similar explosive performances, with no appreciable differences in detonation velocity and cylinder expansion ratio. However, Examples 1 and 3 exhibited much higher ABL impacts than Comparative Examples A and C (although the ABL impact of the LX-19 formulation was found in other tests to range as high as 11). Examples 1 and 3 also exhibited higher ABL friction measurements than Comparative Example C. As manifested by the card tests, the shock sensitivity of Example 3 was also much less than that of Comparative Examples A and C. A comparison of Examples 2 and Comparative Example B reveals similar findings. Thus, overall, the inventive formulation was much less impact and shock sensitive than the comparative examples.

In addition, as shown by the cook-off tests, the inventive formulations were less thermal sensitive than the LX-19 and PGN comparative examples. More specifically, at a confinement of 0.030 inches, Examples 2 and 3 underwent pressure rupture and explosion, respectively, whereas the Comparative Examples underwent more violent partial and complete detonation.

The foregoing detailed description of the preferred embodiments of the invention has been provided for the purposes of illustration and description. It is not intended to be exhaustive or to limit the invention to the precise embodiments disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention cover various modifications and equivalents included within the spirit and scope of the appended claims.

What is claimed is:

1. A pressable or extrudable explosive formulation comprising:

2,4,6,8,10,12-hexanitro-2,4,6,8,10,12-hexaazatetracyclo $[5.5.0.0^{5,9}.0^{3,11}]$-dodecane (CL-20) having a concentration in the explosive formulation of from about 85 wt % to about 96 wt %;

a non-energetic binder comprising cellulose acetate butyrate; and an energetic plasticizer comprising bis-dinitropropyl acetal and bis-dinitropropyl formal.

2. A formulation according to claim 1, wherein the CL-20 is present in the explosive formulation in a concentration of from about 85 wt % to about 95 wt %.

3. A formulation according to claim 1, wherein the CL-20 is present in the explosive formulation in a concentration of from about 94 wt % to about 95 wt %.

4. A formulation according to claim 1, wherein the CL-20 is present in the explosive formulation in a concentration of about 94 wt %.

5. A formulation according to claim 2, wherein the cellulose acetate butyrate is present in the explosive formulation in a concentration of from about 2 wt % to about 2.8 wt %.

6. A formulation according to claim 2, wherein the energetic plasticizer is present in the explosive formulation in a concentration of from about 3.2 wt % to about 4 wt %.

7. A formulation according to claim 1, wherein the CL-20 is present in the explosive formulation in a concentration of from about 94 wt % to about 95 wt %, wherein the cellulose acetate butyrate is present in the explosive formulation in a concentration of from about 2 wt % to about 2.8 wt %, and wherein energetic plasticizer is present in the explosive formulation in a concentration of from about 3.2 wt % to about 4 wt %.

8. A formulation according to claim 1, wherein the CL-20 is present in the explosive formulation in a concentration of about 94 wt %, wherein the cellulose acetate butyrate is present in the explosive formulation in a concentration of about 2.4 wt %, and wherein the energetic plasticizer is present in the explosive formulation in a concentration of about 3.6 wt %.

9. A formulation according to claim 1, wherein a weight ratio of bis-dinitropropyl acetal to bis-dinitropropyl formal is between about 45:55 and about 55:45.

10. A formulation according to claim 1, wherein a weight ratio of bis-dinitropropyl acetal to bis-dinitropropyl formal in the plasticizer is about 50:50.

11. A formulation according to claim 1, wherein the formulation further comprises an stabilizer.

12. A formulation according to claim 11, wherein the stabilizer is at least one member selected from the group consisting of diphenylamine and n-alkyl nitroanilines.

* * * * *